US009950226B2

(12) United States Patent
Meyer

(10) Patent No.: US 9,950,226 B2
(45) Date of Patent: Apr. 24, 2018

(54) SMALL DETACHABLE GOLF BAG

(71) Applicant: Steve Meyer, Van Meter, IA (US)

(72) Inventor: Steve Meyer, Van Meter, IA (US)

( * ) Notice: Subject to any disclaimer, the term of this patent is extended or adjusted under 35 U.S.C. 154(b) by 0 days.

(21) Appl. No.: 14/833,714

(22) Filed: Aug. 24, 2015

(65) Prior Publication Data

US 2016/0059096 A1 Mar. 3, 2016

Related U.S. Application Data

(60) Provisional application No. 62/042,054, filed on Aug. 26, 2014.

(51) Int. Cl.

| | |
|---|---|
| ***A63B 55/00*** | (2015.01) |
| ***A63B 55/04*** | (2006.01) |
| *A63B 55/50* | (2015.01) |
| *A63B 55/40* | (2015.01) |

(52) U.S. Cl.

CPC ..... *A63B 55/045* (2013.01); *A63B 55/00* (2013.01); *A63B 55/008* (2013.01); *A63B 55/408* (2015.10); *A63B 55/40* (2015.10); *A63B 55/50* (2015.10); *A63B 2209/10* (2013.01); *A63B 2210/50* (2013.01)

(58) Field of Classification Search

CPC ..... A63B 55/408; A63B 55/045; A63B 55/57; A63B 2055/601; A63B 55/50

USPC ..... 206/315.2, 315.6, 315.8; 211/70.2

See application file for complete search history.

(56) References Cited

U.S. PATENT DOCUMENTS

| | | | | | |
|---|---|---|---|---|---|
| 1,271,784 | A * | 7/1918 | Simpson | A63B 55/00 | 206/315.6 |
| 1,417,380 | A * | 5/1922 | Hatch | A63B 55/00 | 206/315.6 |
| 1,488,389 | A * | 3/1924 | Hibbert | A63B 55/50 | 206/315.7 |
| 1,715,668 | A * | 6/1929 | Mooney | A63B 55/50 | 206/315.7 |
| 1,780,802 | A * | 11/1930 | Sutcliffe | A63B 55/00 | 206/315.6 |
| 1,826,216 | A * | 10/1931 | Johnson | A63B 55/50 | 206/315.6 |
| 2,045,147 | A * | 6/1936 | Johnson | A63B 55/50 | 206/315.6 |
| 2,595,987 | A | 5/1952 | Shears | | |
| 2,708,955 | A * | 5/1955 | Wilkens | A63B 55/00 | 206/315.6 |
| 3,215,181 | A * | 11/1965 | Reed | A63B 55/10 | 206/315.2 |
| 4,865,192 | A * | 9/1989 | Williams | A63B 55/50 | 206/315.6 |
| 5,222,703 | A * | 6/1993 | Ricciardelli | A63B 55/50 | 248/156 |
| 5,358,109 | A | 10/1994 | Nichols | | |
| 5,472,084 | A * | 12/1995 | Aliano, Jr. | A63B 55/00 | 190/108 |
| 5,816,396 | A | 10/1998 | Shin | | |
| 5,918,737 | A * | 7/1999 | Kwon | A63B 55/00 | 206/315.3 |

(Continued)

*Primary Examiner* — Sue A Weaver

(74) *Attorney, Agent, or Firm* — Zarley Law Firm, P.L.C.

(57) ABSTRACT

A small golf bag assembly having a small golf bag detachably connected to a main golf bag with connection devices, where the small golf bag has an opening with an interior cavity and a strap attached to its exterior. The small golf bag has a stake and one or more legs for stabilization.

8 Claims, 7 Drawing Sheets

(56) References Cited

U.S. PATENT DOCUMENTS

| | | | | |
|---|---|---|---|---|
| 6,126,050 | A * | 10/2000 | Aliano, Jr. | A63B 55/00 206/315.2 |
| 6,758,334 | B2 * | 7/2004 | Uner | A63B 55/408 190/110 |
| 7,044,298 | B1 | 5/2006 | Pryst | |
| 7,059,470 | B2 * | 6/2006 | Slankster | A63B 55/00 206/315.2 |
| D654,268 | S * | 2/2012 | Boncimino | D3/255 |
| 8,201,686 | B2 * | 6/2012 | McGuire | A63B 55/408 206/206 |
| 2002/0066763 | A1 * | 6/2002 | Hsueh | A63B 55/00 224/583 |
| 2002/0195359 | A1 * | 12/2002 | Uner | A63B 55/408 206/315.3 |
| 2004/0188288 | A1 * | 9/2004 | Parpart | A63B 55/10 206/315.7 |
| 2007/0138223 | A1 * | 6/2007 | Brown | A63B 55/00 224/413 |
| 2013/0306505 | A1 * | 11/2013 | Walsh | A63B 55/00 206/315.7 |
| 2015/0014195 | A1 * | 1/2015 | Bowen | A63B 55/008 206/315.6 |

* cited by examiner

SMALL DETACHABLE GOLF BAG

CROSS REFERENCE TO RELATED APPLICATION

This application claims the benefit of U.S. Provisional Application No. 62/042,054 filed Aug. 26, 2014.

BACKGROUND OF THE INVENTION

This invention relates to a golf bag. More specifically and without limitation, this invention is directed towards a small detachable golf bag assembly.

While golfing it is customary to carry a golf bag that holds a variety of clubs used for the different areas and obstacles encountered while playing. Additionally, the golf bag holds a number of other items including golf balls, tees, drinks, towels, etc. All of these items makes carrying a golf bag a physically demanding task, especially over the length of a single hole and the even greater length of an entire golf course.

To address this problem golfers usually opt for using a golf cart to transport the heavy bags between holes as well as to the current location their golf ball has been hit to. Golf carts, however, are not permitted on the greens of most golf courses in order to avoid potential damage caused by the carts to the meticulously cared for greens. Thus, once a player's golf ball is on the green they must remove their golf bag from the cart and carry it to the green. This is necessary because a golfer does not necessarily know which club will be needed to complete their play on the green and an unfortunate golfer may need more than one club to complete the hole.

Another issue encountered while playing on a green is that the player must lay down their golf bag during play. Golf bags, and the clubs they carry, are often very expensive and laying down the bag risks damage to the bag and its contents. Additionally, the player must then pick up the heavy bag and place it back on their shoulder to return it to the golf cart before continuing onto the next hole.

There is a need in the prior art to address these problems and more. Thus it is a primary object of the invention to provide a small detachable golf bag assembly that improves upon the state of the art.

Another object of the invention is to provide a small detachable golf bag assembly that is easily detachable from the main golf back.

Yet another object of the invention is to provide a small detachable golf bag assembly that is lightweight and durable.

Another object of the invention is to provide a small detachable golf bag assembly that can stand upright when not being held.

Yet another object of the invention is to provide a small detachable golf bag assembly that is comfortable.

Another object of the invention is to provide a small detachable golf bag assembly that has an intuitive design.

Yet another object of the invention is to provide a small detachable golf bag assembly that protects golf clubs from damage;

Another object of the invention is to provide a small detachable golf bag assembly that reduces the physical strain of carrying golf clubs;

These and other objects, features, or advantages of the present invention will become apparent from the specification and claims.

SUMMARY OF THE INVENTION

A small golf bag assembly having a small golf bag detachably connected to a main golf bag with connection devices, where the small golf bag has an opening with an interior cavity and a strap attached to its exterior. The small golf bag has a stake and one or more legs for stabilization.

The stake can be extendable by way of being housed within the small golf bag or by being recessed telescopically beyond a ridge on the bottom of the small golf bag. Alternatively, the stake can be hingedly connected and rest flushly against the bottom of the small golf bag or received within a notch.

The interior of the small golf bag, in some embodiments, has dividers for easily sorting clubs for simplifying selection. Also, connection devices allow for simple and quick detachment and reattachment.

DETAILED DESCRIPTION OF THE PREFERRED EMBODIMENTS

Figure 1:
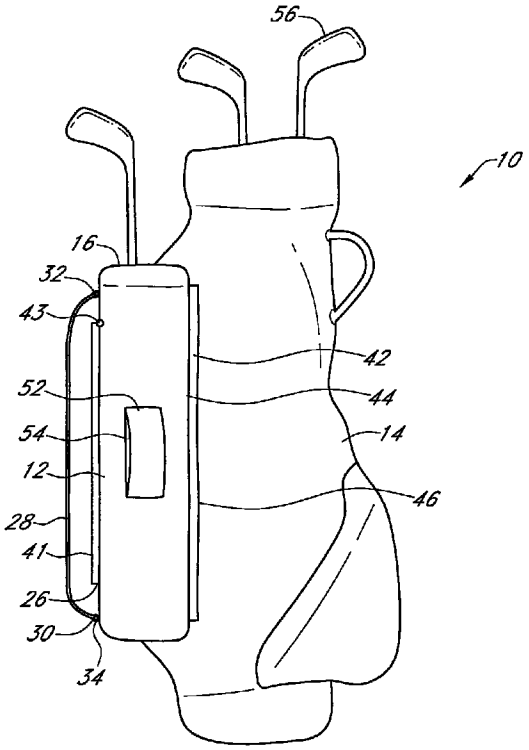
FIG. 1 is a perspective view of a small detachable golf bag attached to a main golf bag.
Figure 2:
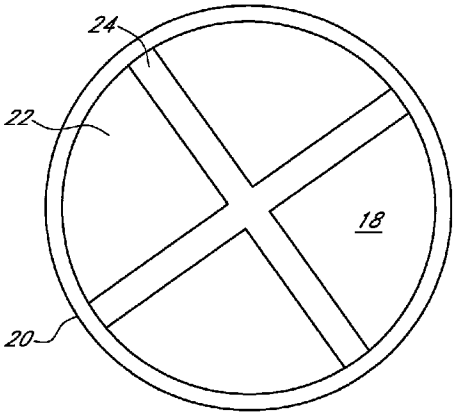
FIG. 2 is a top view of a small detachable golf bag.
Figure 3A:
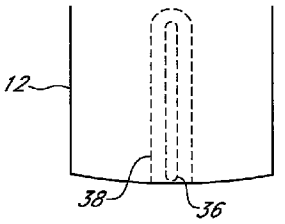
FIG. 3A is a side view of a stake of a small detachable golf bag.
Figure 3B:
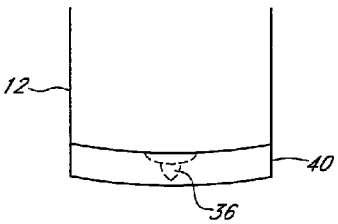
FIG. 3B is a side view of a stake of a small detachable golf bag.
Figure 3C:
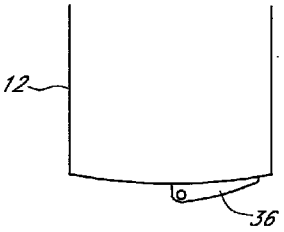
FIG. 3C is a side view of a stake of a small detachable golf bag.
Figure 3D:
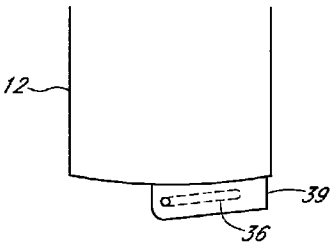
FIG. 3D is a side view of a stake of a small detachable golf bag.
Figure 4A:
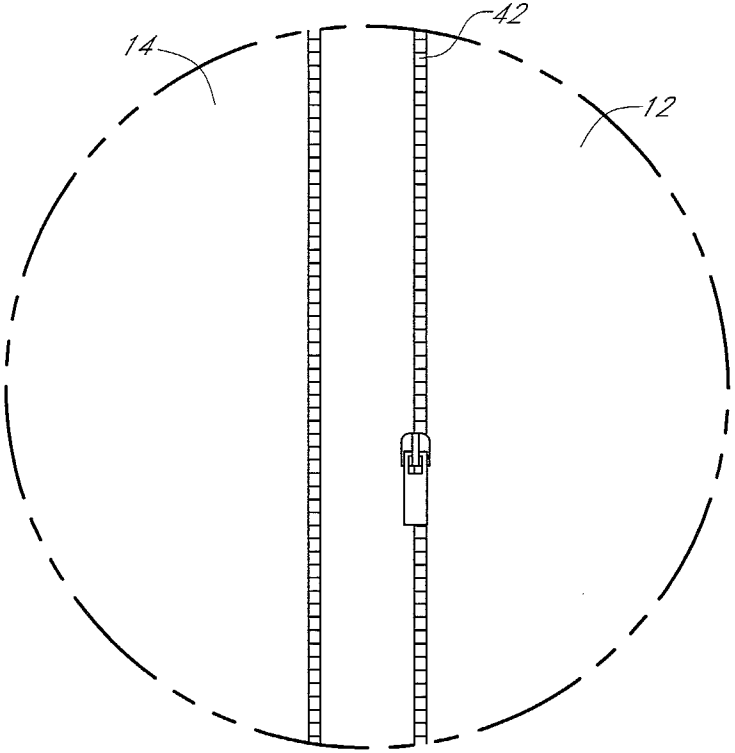
FIG. 4A is a side view of a connection device of a small detachable golf bag.
Figure 4B:
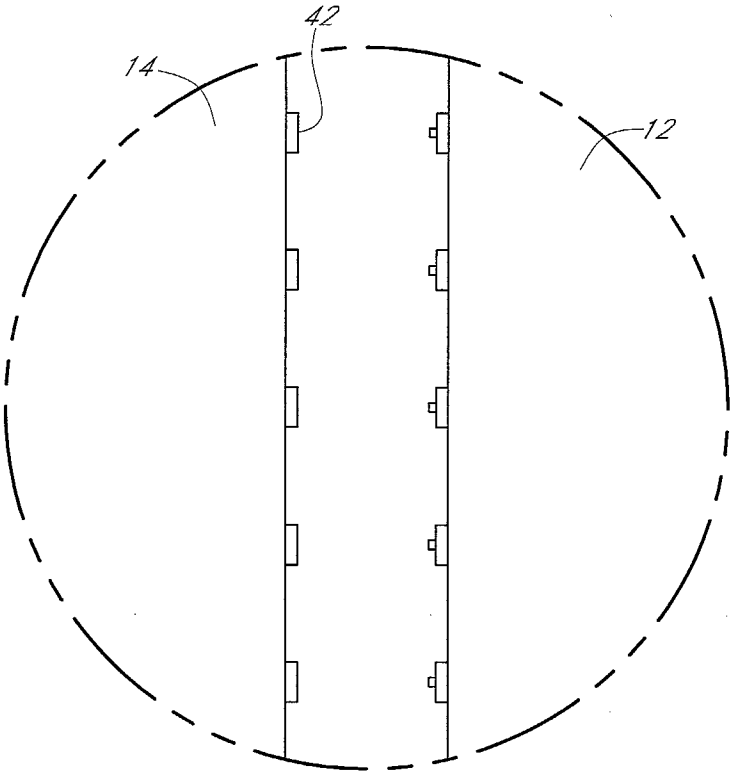
FIG. 4B is a side view of a connection device of a small detachable golf bag.
Figure 4C:
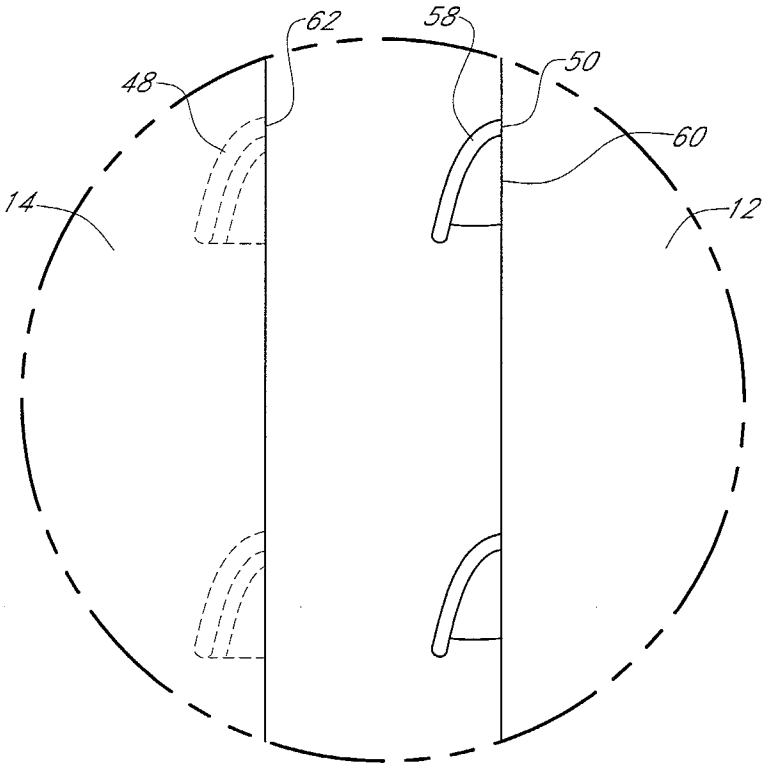
FIG. 4C is a side view of a connection device of a small detachable golf bag.
Figure 5:
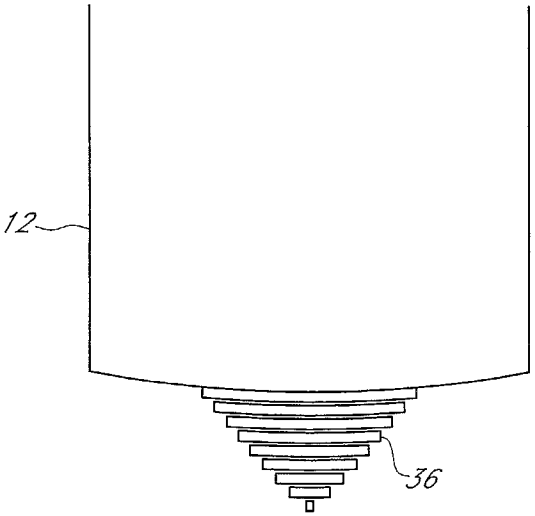
FIG. 5 is a side view of a stake of a small detachable golf bag.

With reference to the figures, a small golf bag assembly 10 is presented. The small golf bag assembly 10 includes a small golf bag 12 and a main golf bag 14.

The small golf bag 12 is cylindrical in shape and made of fabric. In one embodiment is made from the same fabric as the main golf bag 14 and is preferably water and weather resistant. The top of the small golf bag 12 has an opening 16 to an interior cavity 18 of the small golf bag 12. In one arrangement, the opening 16 of the small golf bag 12 has a protective ring 20 around the opening 16 to protect from damage.

In one arrangement, the interior cavity 18 is divided into a plurality of sections 22. The sections 22 are formed by a plurality of dividers 24 that can be made of any material including fabric, plastic, or metal.

Attached to the exterior of a back side 26 of the small golf bag 12 is a strap 28. The strap 28 is attached to the back side 26 by attachment devices 30 at the top and bottom of the small golf bag 12. In one embodiment, the attachment devices 30 are hooks 32 that detachably attach to holes 34 in the strap 28. In other embodiments, the strap 28 is sewn or attached directly to the small golf bag 12 such that the strap cannot be removed.

On the bottom of the small golf bag 12 is an extendable stake 36. In one arrangement, the stake 36 is received within a housing 38 of the small golf bag 12 when not being used. In another arrangement, the bottom of the small golf bag 12 has a ridge 40 that extends down from the bottom of the small golf bag 12 and the staked 36 is telescopically attached to the bottom of the golf bag 12 such that when retracted the stake 36 does not extend beyond the ridge 40.

In yet another embodiment, the stake 36 is hingedly attached to the bottom of the small golf bag 12 such that when not extended the stake 36 rests flush with the bottom. Alternatively in this embodiment, when the stake 36 is not extended the stake 36 is received within a notch 39. In this arrangement, the stake 36 is secured within, the notch 39 to prevent the stake 36 from causing injury.

In an alternative embodiment, one or more legs 41 are hingedly connected at one end to the top of the small bag 12, such that when the legs 41 are pulled away from the small bag 12 the legs 41 provide additional support to keep the small golf bag 12 off of the ground. In one embodiment, at least two legs 41 are hingedly connected at the same point 43 of the small bag 12 and when extended the two legs 41 separate and angle apart from the other leg 41 such that the bottom of the small bag 12 at the legs 41 form a tripod.

A connection device 42 connects a front side 44 of the small golf bag 12 to the main golf bag. As shown in the figures, the connection device 42 is a zipper that extends around a portion 46 of the small golf bag 12 and the main golf bag 14. In another arrangement, the connection device 42 is a plurality of releasable snaps that extend around the portion of the small golf bag 12 and the main golf bag 14. In yet another arrangement, the connection device 42 has a plurality of slots 48 positioned on the main golf bag 14 that receives a plurality of tabs or hooks 50 positioned on the small golf bag 12. The tabs 50 in one embodiment have a larger top portion 58 that is received in the slots 48 and a narrower portion 60 such that the tabs 50 are retained in position by the larger portion 58 being received within a larger opening 62 at the top of the slots 48 where the remaining portion of the slots 48 is too narrow for the larger portion 58 to pass through. Although these arrangements are illustrative other connection devices 42 such as Velcro are contemplated.

In one arrangement, the small golf bag 12 is integrated into the main golf bag 14 such that the small golf bag 12 and the main golf bag 14 have a uniform body when the small bag 12 is attached. In one embodiment, the main golf bag 14 and small golf bag 12 have dividers 24 that are connected to one another with connection devices 42, preferably slots 48 and hooks 50. In this way, the small golf bag 12 can be selectively detached from the main golf bag 14 with the sections 22 the player desires for play.

In one embodiment, the exterior of the small golf bag 12 has a plurality of pockets 52 to hold additional golf balls, pencil, paper, or other items that are used while golfing. The pockets 52 have sealing devices 54 that allow the pockets 52 to be closed and thereby securing the contents of the pockets 52. The sealing devices 54 can include a zipper or a button flapped.

In Operation:

A player arrives at a putting green and selects the desired clubs 56 that the player wishes to use by removing them from the main golf bag 14. The player then places the selected clubs 56 within the interior cavity 18 of the small golf bag 12. In particular, the player places individual clubs 56 into separate sections 22 so that the dividers 24 provide additional protection to the clubs 56. The player then places any other items, such as a pencil and paper to track scores into the pockets 52 of the small golf bag 12.

Once the small golf bag 12 is loaded, the player removes the small golf bag 12 from the main golf bag 14 by releasing the connection device 42. For illustration, in one embodiment the player lifts the tabs 50 attached on the front side 44 of the small golf bag 12 from the slots 48 disposed on the main golf bag 14.

After the small golf bag 12 is removed, the player places the strap 28 over their shoulder and carries the small golf bag 12 to where play is to continue from. If needed, the strap 28 can be removed when the small golf bag 12 is not detached from the main golf bag 14 by removing the strap 28 from the attachment devices 30. Next, the player removes the strap 28 from their shoulder and extends the stake 36 from the bottom of the small golf bag 12. For illustration, in one embodiment the player releases the stake 36 from the notch 39 on the bottom of the small golf bag 12. The player then places the stake 36 in the ground such that the small golf bag 12 remains upright without being held.

After the player finishes play on the green, the player removes the small golf bag 12 from the ground. The player next places the stake 36 back in the notch 39. In other embodiments, the player retracts the stake 36 into the ridge 40 or housing 38. In yet another embodiment, the player simply pivots the stake 36 so that it is flush with the bottom of the small golf bag.

The player then returns the small golf bag 12 to the golf cart where it is reattached to the main golf bag 14 using the connection devices.

From the above discussion, it will be appreciate that the small detachable golf bag assembly presented improves upon the state of the art. Thus it is a primary objective of the invention is to provide a small detachable golf bag assembly that improves upon the state of the art. That is, the small detachable golf bag assembly presented is easily detachable from the main golf back; is lightweight and durable; stands upright when not being held; is comfortable; protects golf clubs from damage; and reduces the physical strain of carrying golf clubs.

It will be appreciated by those skilled in the art that other various modifications could be made to the device without parting from the spirit and scope of this invention. All such modifications and changes fall within the scope of the claims that are intended to be covered thereby.

What is claimed:

1. A small golf bag assembly comprising a main golf bag;

a small golf bag directly and detachably connected to an exterior surface of the main golf bag by a connection device;

wherein the connection device is positioned on, and matingly configured to form a continuous, uniform body between the main golf bag, the connection device, and the small golf bag when the small golf bag is attached to the main golf bag;

the small golf bag having an opening to an interior cavity that does not extend into the main golf bag;

a strap attached to a back side of the small golf bag;

a stake connected to the bottom of the small golf bag; and a ridge extending down from the bottom of the small golf bag, wherein the stake is telescopically attached to the bottom of the small golf bag such that when retracted the stake does not extend beyond the ridge.

2. The small golf bag assembly of claim 1 further comprising the opening having a protective ring.

3. The small golf bag assembly of claim 1 further comprising the interior cavity having a plurality of sections formed by a plurality of dividers.

4. The small golf bag assembly of claim 1 further comprising attachment devices attached at the top and bottom of the small golf bag that the strap is attached to.

5. The small golf bag assembly of claim 1 wherein the connection device is a zipper.

6. The small golf bag assembly of claim 1 wherein the connection device is a plurality of releasable snaps.

7. The small golf bag assembly of claim 1 wherein the connection device is a plurality of slots positioned on the main golf bag and a plurality of tabs positioned on the small golf bag.

8. The small golf bag assembly of claim 1 further comprising at least one pocket positioned on the exterior of the small golf bag.

* * * * *